US005171140A

United States Patent [19]

Schäfer et al.

[11] Patent Number: 5,171,140

[45] Date of Patent: Dec. 15, 1992

[54] SPIRAL DISPLACEMENT MACHINE WITH ANGULARLY OFFSET SPIRAL VANES

[75] Inventors: Otto Schäfer; Claus Müller, both of Wolfsburg, Fed. Rep. of Germany

[73] Assignee: Volkswagen AG, Fed. Rep. of Germany

[21] Appl. No.: 770,569

[22] Filed: Oct. 3, 1991

[30] Foreign Application Priority Data

Oct. 19, 1990 [DE] Fed. Rep. of Germany ..... 4033264

[51] Int. Cl.[5] ..... F01C 1/04

[52] U.S. Cl. ..... 418/55.2; 418/60

[58] Field of Search ..... 418/55.2, 60

[56] References Cited

U.S. PATENT DOCUMENTS 4,626,179 12/1986 Terauchi ..... 418/55.2
4,715,797 12/1987 Guttinger ..... 418/55.2
4,861,244 8/1989 Kolb et al. ..... 418/55.2

FOREIGN PATENT DOCUMENTS 59-54701 3/1984 Japan ..... 418/55.2
1-53087 3/1989 Japan ..... 418/55.2

OTHER PUBLICATIONS

MTZ Motortechnische Zeitschrift 46 (1985) at pp. 323-327.

*Primary Examiner*—John J. Vrablik
*Attorney, Agent, or Firm*—Brumbaugh, Graves, Donohue & Raymond

[57] ABSTRACT

A spiral displacement machine has a displacer with a central disk and spiral vanes on both sides arranged to revolve eccentrically in a housing with spiral vanes to provide working chambers which rotate spirally. The beginning and end regions of the vanes are angularly offset so that the working chambers do not open or close simultaneously.

3 Claims, 3 Drawing Sheets

SPIRAL DISPLACEMENT MACHINE WITH ANGULARLY OFFSET SPIRAL VANES

BACKGROUND OF THE INVENTION

This invention relates to spiral displacement machines in which a displacer having spiral vanes is driven eccentrically in a housing having spiral vanes.

Spiral displacement machines, which are also called spiral superchargers or volute superchargers, are disclosed in MTZ Motortechnische Zeitschrift 46 (1985) at pages 323-327. They are used especially for supercharging internal combustion engines. For this purpose, a displacer which revolves eccentrically is mounted in a housing. Both the housing and the displacer have spiral vanes which interact with one another periodically and together form working chambers which rotate spirally in the housing. To obtain the highest possible efficiency, both the outer and inner surfaces of the vanes of each of the two parts, i.e., the housing and the displacer, are used periodically to form a working chamber with the inner or outer surface of the other of the two parts, i.e., the displacer or the housing. In addition, the number of working chambers is doubled by providing two spiral vanes symmetrically arranged about the axis of the displacer. To avoid having spiral vanes which extend a long distance in the axial direction from a supporting disk, the displacer consists of a central disk with spiral vanes extending axially from both sides of the disk. In this way, a total of eight working chambers is obtained, and when the vane arrangement is completely symmetrical, as described in the above-cited MTZ publication, all of the working chambers open and close simultaneously. The resulting pressure variation, particularly at the outlet of the spiral displacement machine, produces a high noise level, which requires effective acoustic insulation.

SUMMARY OF THE INVENTION

Accordingly, it is an object of the present invention to provide a spiral displacement machine which overcomes the above-mentioned disadvantages of the prior art.

Another objeot of the invention is to provide a spiral displacement maohine arranged to generate less noise.

These and other objects of the invention are attained by providing a spiral displacement machine which includes a housing and a displacer, each having a plurality of vanes which cooperate to form working chambers, in which the beginning and end regions of the vanes are offset so that not all of the working chambers are opened to an outlet and/or an inlet simultaneously. In principle, the invention relates to the arrangement of the spiral vanes in the housing as well as in the displacer, but only the relative positions of the vane end regions with respect to each other is of importance. This offset end vane arrangement according to the invention reduces the maximum amplitude of the noise generated during operation of the displacement machine.

In one embodiment of the invention, the vane ends are offset so that no two working chambers are ever opened to an outlet and/or inlet at the same time. This arrangement ensures a minimum of noise generation.

If desired, the vanes in either the housing or the displacer may be disposed symmetrically, in particular, centrically symmetric to one another, while the vanes of the other of those two parts of the spiral displacement machine, preferably the displacer, are arranged so that their end regions are offset. Such symmetric vane arrangement in one of the parts facilitates manufacture of the part without eliminating the noise reduction effected by the invention. Preferably, the displacer consists of a central disk having vanes on each side and the housing is formed with corresponding vanes on both sides of the disk. In this case, the ends of the displacer vanes on the opposite sides of the disk are preferably offset so that no working chamber is opened or closed at the same time as another chamber. Even if the spiral displacement machine has only a single working chamber on each side of a central disk, this arrangement results in effective noise reduction.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
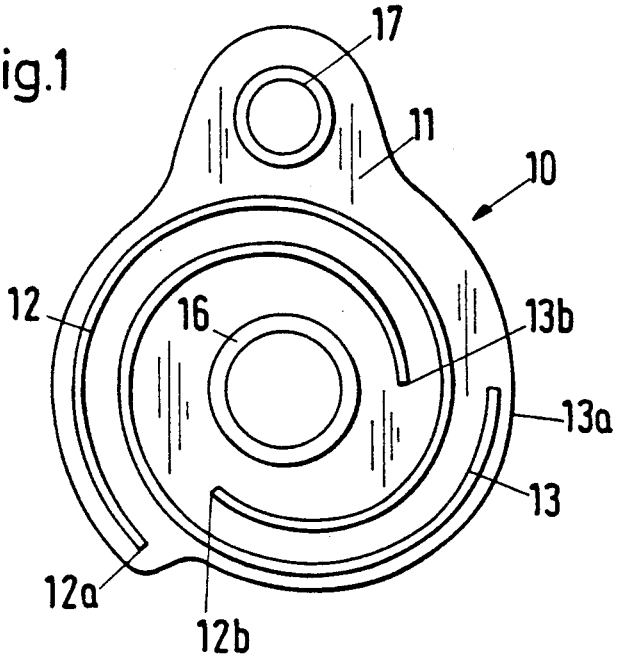
FIG. 1 is a plan view of a representative central disk displacer arranged according to the invention, looking in the direction of the arrows I—I of FIG. 3 and showing the disposition of the spiral vanes.
Figure 2:
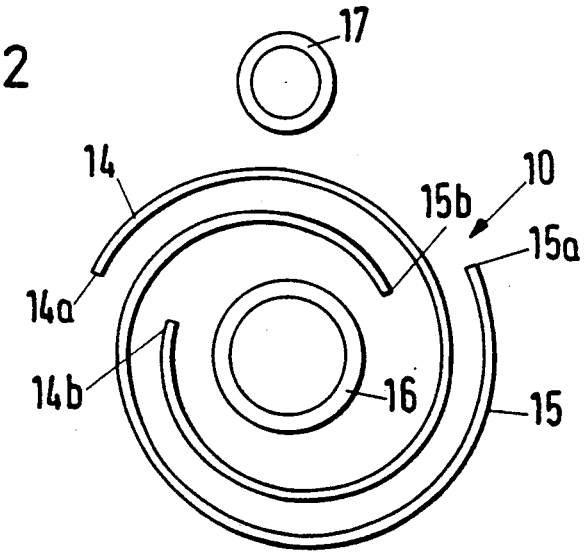
FIG. 2 is a sectional view of the displacer shown in FIG. 1, taken on the lines II—II of FIG. 3 and looking in the direction of the arrows, illustrating the arrangement of the vanes on the other side of the central disk.

In the typical embodiment of the :nvent:on shown in the drawings, a displacer 10 for a spiral displacement machine has a central disk 11 with two vanes 12 and 13 on one side, shown in FIG. 1, and two further vanes 14 and 15, shown in FIG. 2, on the other side. As illustrated in the drawings, all of the vanes have the same spiral direction, i.e., progressing inwardly in the clockwise direction as viewed in FIGS. 1 and 2. The vane reference numeral with the suffix "a" designates the beginning of each vane and the vane reference numeral with the suffix "b" designates the end of the vane.

Figure 3:
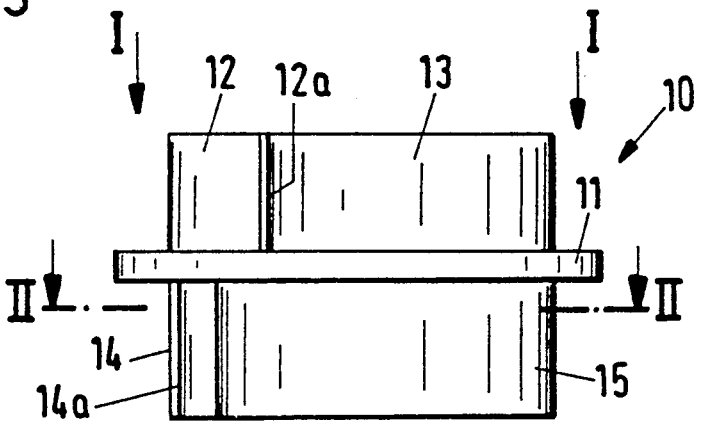
FIG. 3 is a side view of the displacer shown in FIGS. 1, 2.
Figure 4:
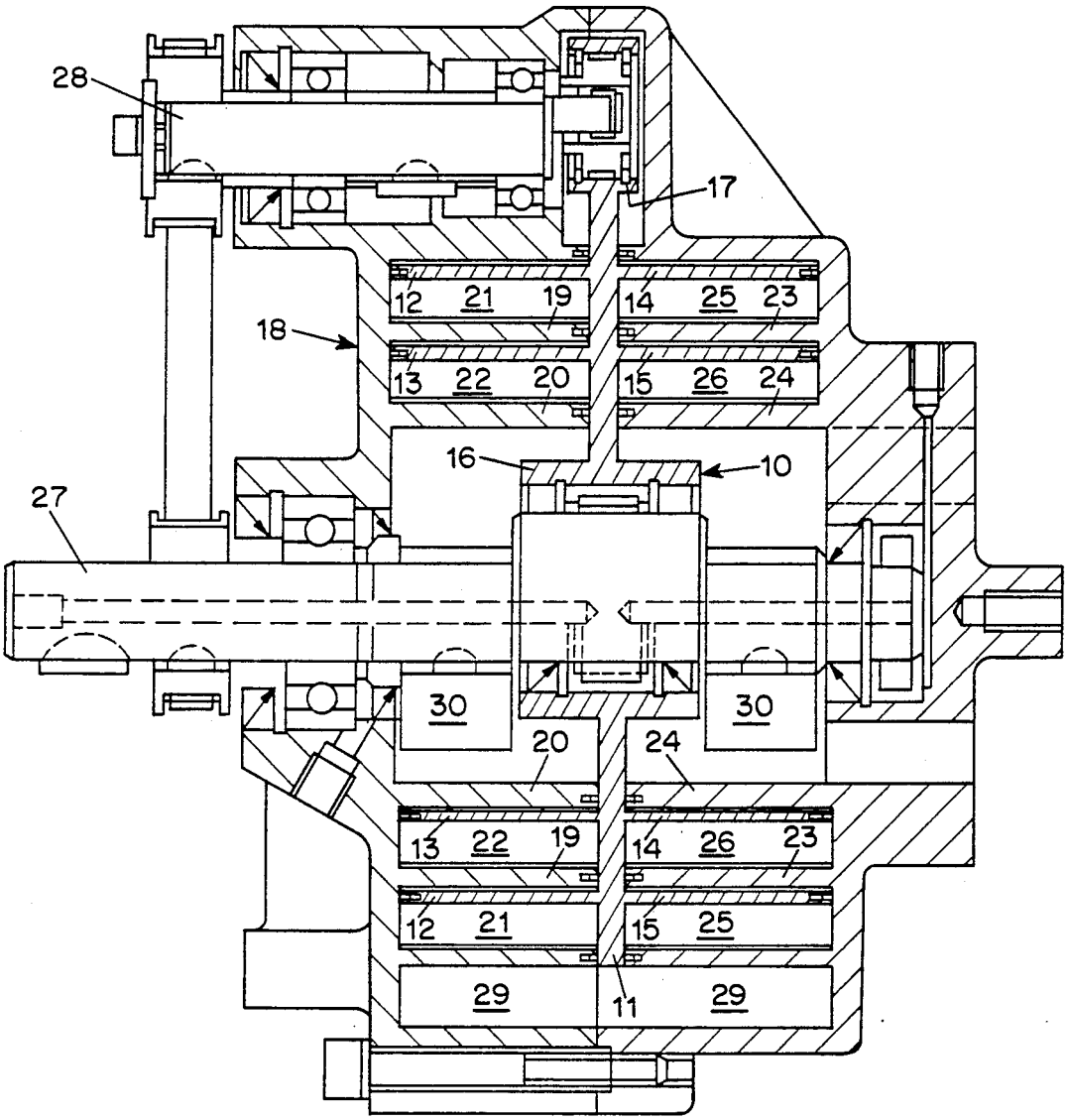
FIG. 4 is a cross-sectional view of a spiral supercharger including a housing containing the displacer of FIGS. 1-3.

The terms "vane beginning" and "vane end" refer to the direction of flow of the working medium, which is fed into four working chambers 21, 22, 25 and 26 shown in FIG. 4 which rotat spirally from the outside inward during operation of the machine. Accordingly, the reference number 12*a* refers to the outer beginning of the vane 12 and the number 12*b* to the inner end of that vane. Similar designations apply in the same way to the ends of the other vanes 13-15. FIG. 3 shows the direction in which the displacer is viewed in FIGS. 1 and 2. FIG. 1 is thus a top or plan view of the displacer 10 in the direction of the arrows I in FIG. 3 and FIG. 2 is a sectional view of the displacer 10 taken along the line II—II in FIG. 3.

As shown in FIG. 4, which is the sectional view of the supercharger shown at page 324 of MTZ Motortechnische Zeitschrift 46 (1985), the displacer 10 of FIGS. 1–3 is mounted in a housing 18 having two spiral vanes 19 and 20 forming two working chambers 21 and 22, respectively, on one side of the disk 11 and two furth3er spiral vanes 23 and 24 forming corresponding working chambers 25 and 26, respectively, on the other side of the disk 11. The vanes 12 and 13 cooperate with the vanes 19 and 20 within the chambers 21 and 22, respectively, and the vanes 14 and 15 cooperate with the vanes 23 and 24 within the chambers 25 and 26, respectively.

FIGS. 1 and 2 show a main hub 16 in the disk 11 for a driveshaft 27, shown in FIG. 4, andf a secondary hub 17 for a guide shaft 28, likewise shown in FIG. 4. The basic design of the displacer also includes intake openings 29 and outlet openings 30 for the working medium and thus corresponds to that illustrated in MTZ Motortehnische Zeitschrift 46 (1985), page 324. The difference, however, is in the positioning of the ends of the individual vanes according to the invention. Each of the vanes 12–15 extends over an angle of 360°. As shown in FIGS. 1 and 2, the beginnings and ends of the two spiral vanes 12 and 13 on one side of the disk 11 and of the two vanes 14 and 15 on the other side are offset so that the vane beginnings **12*a* and 13*a* are not displaced by 180°, but have a displacement of about 135°. The same applies to the vane ends 12*b* and 13*b*. The vane beginnings 14*a* and 15*a*** are similarly offset by about 135°.

Figure 5:
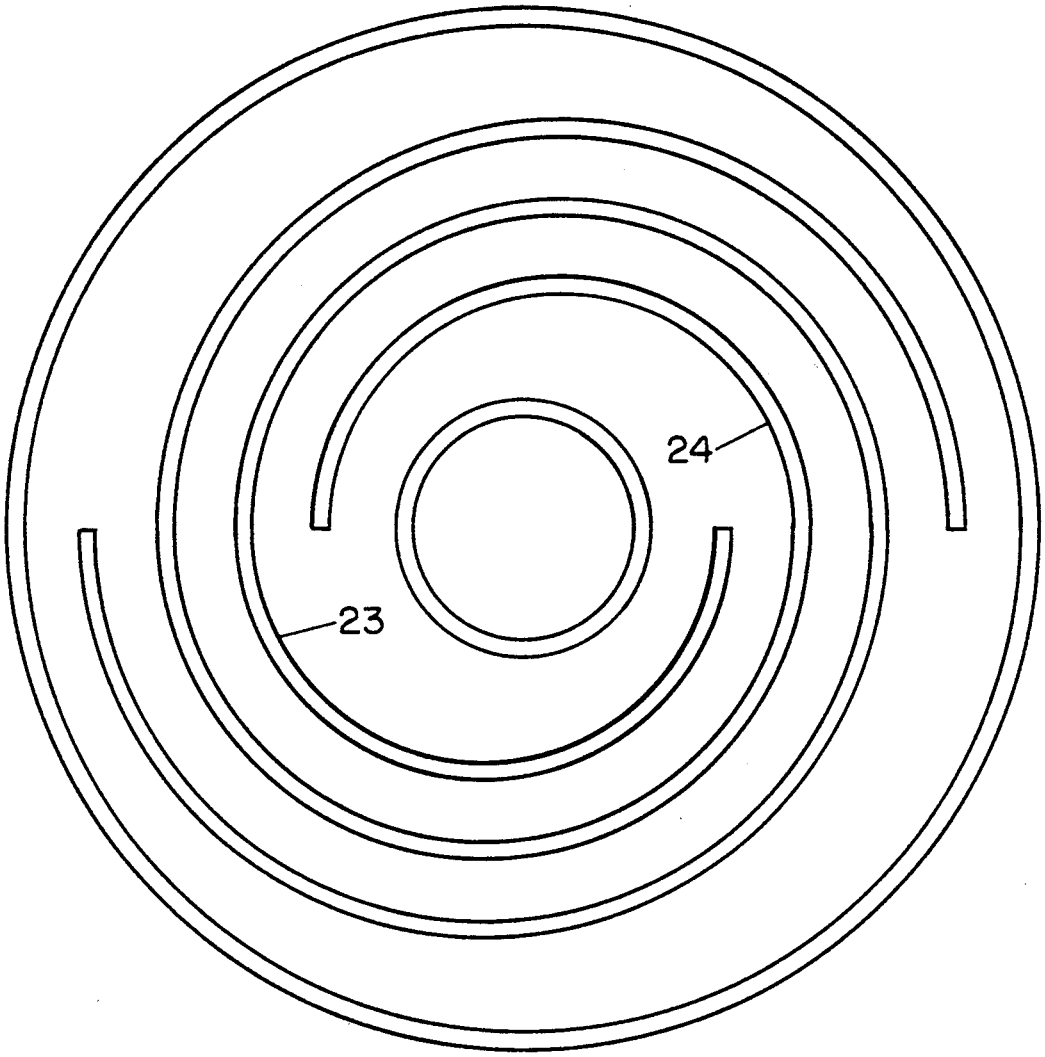
FIG. 5 is a schematic sectional view showing a typical housing vane arrangement for use with the displacer of FIGS. 1-3.

In addition, however, the beginnings of the vanes **14*a* and 15*a* are similarly offset relative to the vane beginnings 12*a* and 13*a*. If the angular location of the vane beginning 13*a* is defined as 0° and the angle is measured clockwise, the vane beginning 12*a* is located at about 135°, the vane beginning 14*a* is at about 210°, and the vane beginning 15*a* is at 330°. If the housing in which the displacer is mounted has four spiral vanes which are arranged essentially symmetrically in parallel pairs with each vane extending over 360° or 540°, unlike opening times are obtained for all of the individual working chambers because of the vane arrangement on the displacer 10, as described. One such housing vane arrangement is shown in FIG. 5, in which one pair of vanes 23 and 24** disposed on one side of the displacer are symmetrically arranged and extend over 540°.

The described arrangement of the vanes 12–15 on the displacer 10 is especially favorable because there is only a small displacement between the two vanes on each side of the central disk 11 so that the associated additional moments resulting from the asymmetry are tolerable.

Although the invention has been described herein with reference to specific embodiments, many modifications and variations therein will readily occur to those skilled in the art. Accordingly, all such variations and modifications are included within the intended scope of the invention.

We claim:

1. A spiral displacement machine comprising a housing having an inlet opening to receive working medium and an outlet opening for compressed working medium and having at least two spiral vanes, a displacer supported for eccentric motion in the housing and having at least two spiral vanes which cooperate with the spiral vanes of the housing to form corresponding working chambers that move spirally in response to displacer motion in the housing, each of the spiral vanes having a beginning region and an end region, the beginning and end regions of the vanes of at least one of the displacer and the housing being angularly offset so that only one of the working chambers is open to one of the inlet and outlet openings at any given time during operation.

2. A spiral displacement machine according to claim 1 wherien the spiral vanes of one of the housing and the displacer which are disposed in a particular plane are disposed essentially symmetrically, while the cooperating vanes of the other of the displacer and the housing which are disposed in the same particular plane are angularly offset with respect to each other.

3. A spiral displacement machine according to claim 1 wherien the displacer includes a central disk with vanes disposed on opposite sides of the disk and wherein the housing has divided vanes for accommodating the displacer with the central disk, and wherien the beginning and end regions of the vanes on the displacer are offset on both sides of the central disk so that no working chamber opens simultaneously with another working chamber.

* * * * *